US012570495B2

(12) United States Patent
Steger et al.

(10) Patent No.: US 12,570,495 B2
(45) Date of Patent: Mar. 10, 2026

(54) WIRE SPINNER

(71) Applicant: Jags Enterprise LLC, Theresa, WI (US)

(72) Inventors: James Steger, Lomira, WI (US); Geralyn Aubrey, Theresa, WI (US)

(73) Assignee: JAGS Enterprise LLC, Theresa, WI (US)

( * ) Notice: Subject to any disclaimer, the term of this patent is extended or adjusted under 35 U.S.C. 154(b) by 89 days.

(21) Appl. No.: 18/640,115

(22) Filed: Apr. 19, 2024

(65) Prior Publication Data

US 2025/0326604 A1 Oct. 23, 2025

(51) Int. Cl.
*B65H 49/32* (2006.01)
*B65H 75/36* (2006.01)

(52) U.S. Cl.
CPC ..... *B65H 49/32* (2013.01); *B65H 75/364* (2013.01)

(58) Field of Classification Search
CPC ..... B65H 49/32; B65H 49/328; B65H 75/364
See application file for complete search history.

(56) References Cited

U.S. PATENT DOCUMENTS

| | | | | | |
|---|---|---|---|---|---|
| 4,089,486 | A * | 5/1978 | Carter | B65H 49/28 | 242/129 |
| 4,664,260 | A * | 5/1987 | Stokes | B65D 21/0231 | 242/129 |
| 9,796,556 | B1 * | 10/2017 | Hill | B65H 49/32 | |
| 2003/0089818 | A1 * | 5/2003 | Reau | B65H 49/28 | 242/588.6 |
| 2006/0196989 | A1 * | 9/2006 | Bartley | B65H 49/08 | 242/605 |
| 2011/0048987 | A1 * | 3/2011 | Arnetoli | B65H 49/08 | 206/349 |

* cited by examiner

*Primary Examiner* — Sang K Kim
(74) *Attorney, Agent, or Firm* — Ryan Kromholz & Manion, S.C.

(57) ABSTRACT

A wire spinner having a support structure having an upright support connected to a base. The upright support section has a generally conical shape. The base has a general ring shape. A rotating device is located on top of the base and internally of the support structure.

4 Claims, 5 Drawing Sheets

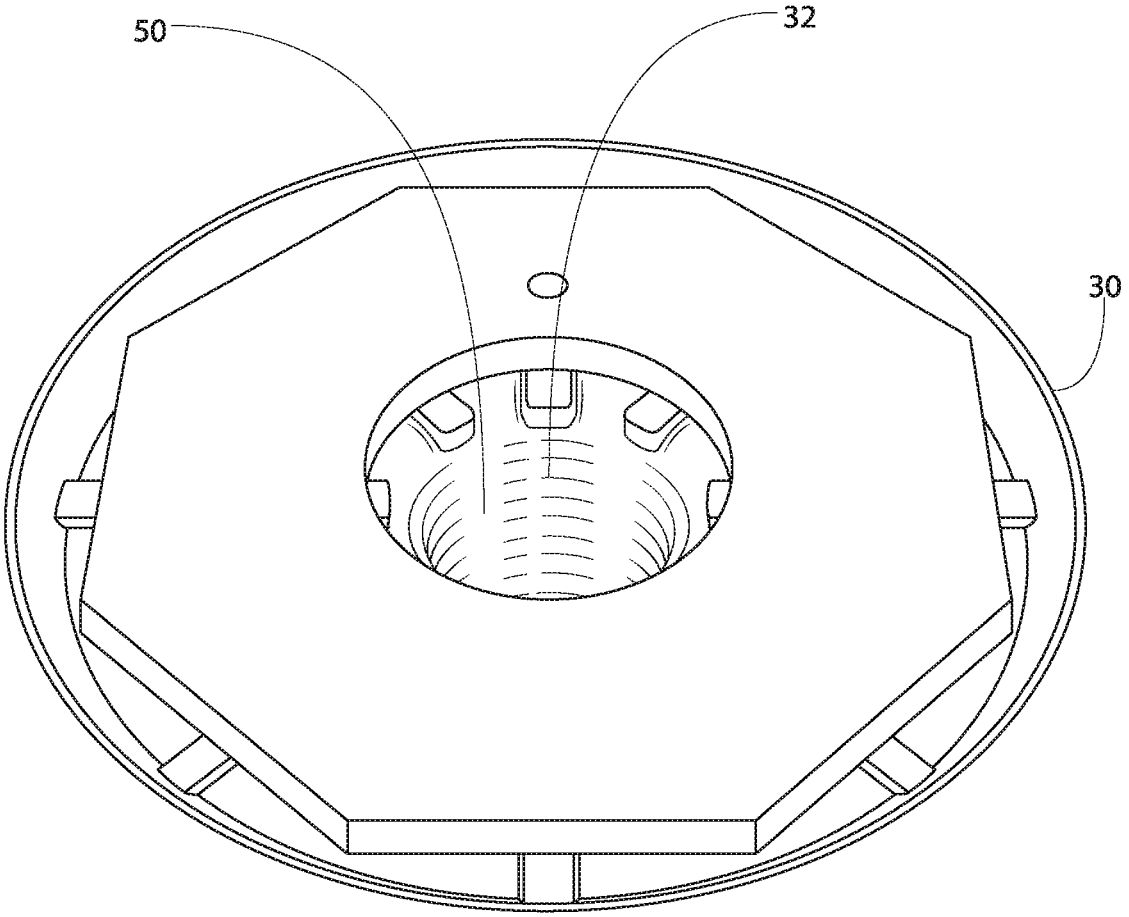
*Fig. 3*
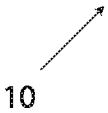

Fig. 4
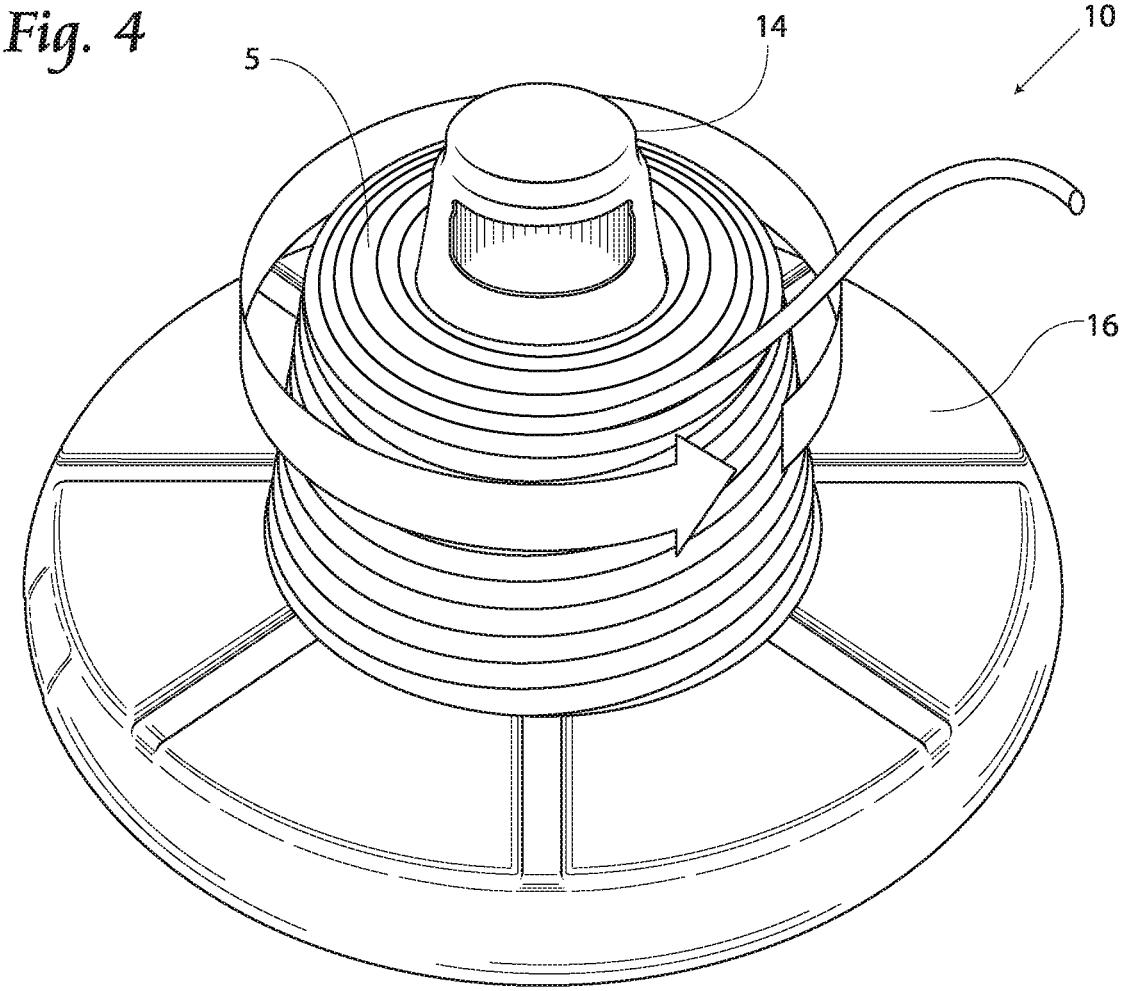
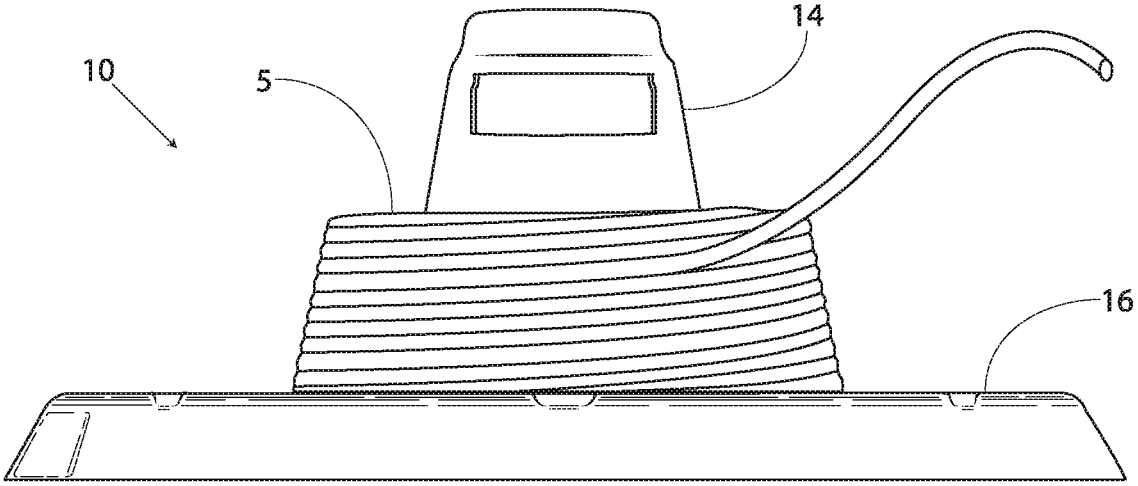
Fig. 5

WIRE SPINNER

BACKGROUND OF THE INVENTION

The present invention relates to devices for storing and dispensing wires and similar materials and more particularly to wire spinners.

Wire spinners or wire wheels are common devices used on construction sites for a wide variety of materials, such as cables, electrical wires, flexible conduit or other similarly shape materials. The wire spinners allow the user to store the materials without the materials getting tangled. They generally comprise a platform with an upright pole or structure extending from the middle of the platform While prior art wire spinners are helpful in storing wire and similar material, they do have shortcomings. While a wire spinner initially forms a well stored spool of wire, the pool often starts to get messed up and tangled as the wire spool is being used. Similarly, different sizes and types of wires and materials can be used at one construction site. Multiple wire spinners can take up space, not only at a work site, but also in a work van or vehicle.

An improved wire spinner is desired.

SUMMARY OF THE INVENTION

The present invention is directed toward improved methods and systems for storing and dispensing wire and more particularly improved wire spinners and wire dispensers.

In one aspect of the present invention, a wire spinner according to the present invention comprises a support structure having an upright support section connected to a base. The upright support section has a generally conical shape. The base has a general ring shape. A rotating device is located on top of the base and internally of the support structure. The wire spinner also has an opening that can act as a handle for the wire spinner.

In another aspect, the present invention is directed towards a wire spinner and a set of wire spinners that are capable of being stacked upon one another.

BRIEF DESCRIPTION OF DRAWINGS

FIG. 3 is a bottom perspective view of the wire spinner of FIG. 1.

FIG. 4 is a perspective view of the wire spinner of FIG. 1 with wire being situated upon the wire spinner.

FIG. 5 is a second perspective view of the wire spinner with wire on the wire spinner, with wire having been dispensed from the wire spinner.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

In the present invention, wire as used in the present invention refer to flexible, elongated material such as electrical wiring, conduits, cable, or other similar flexible construction materials.

Figure 1:
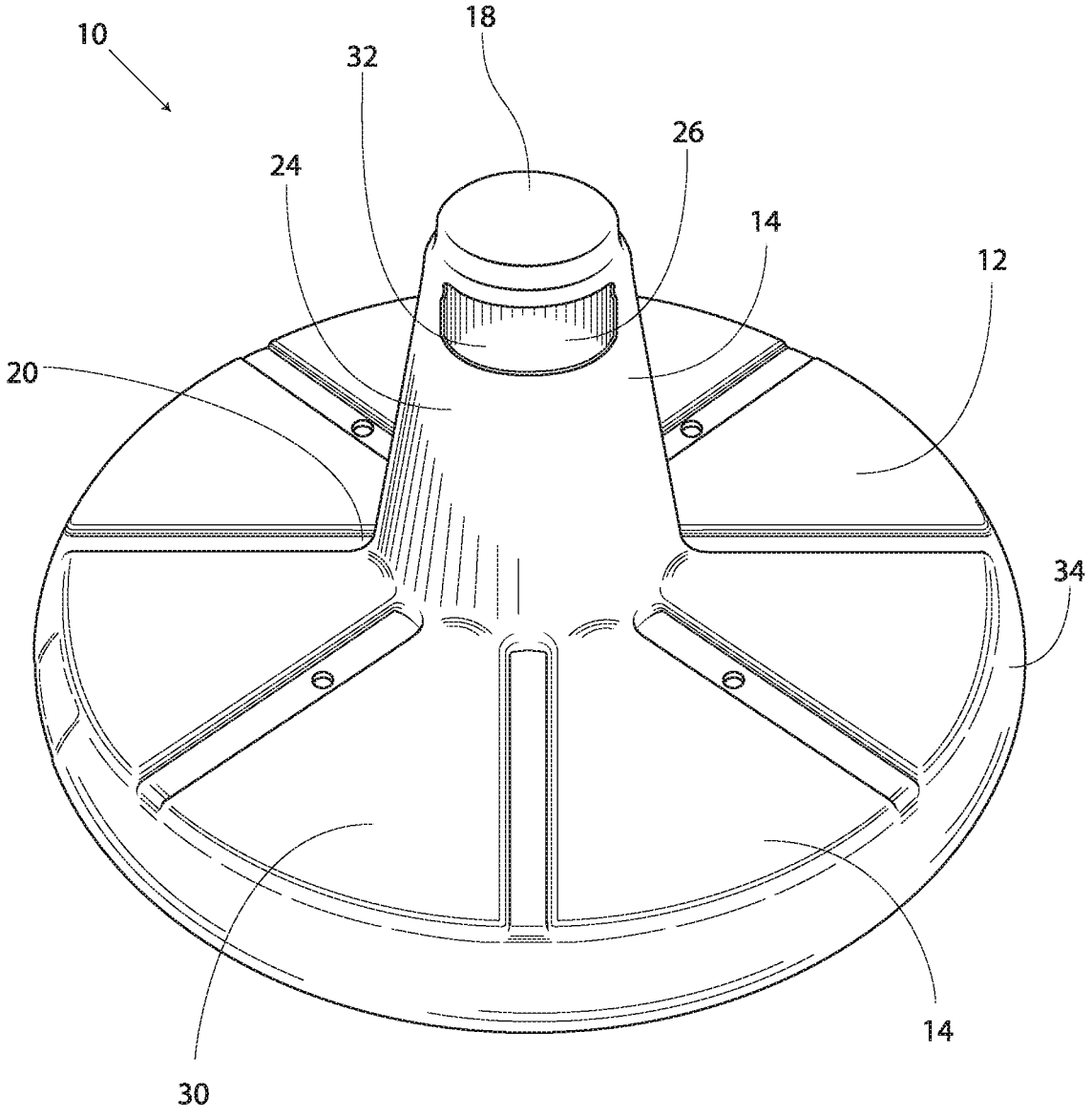
FIG. 1 is a perspective view of a wire spinner according to the present invention.

FIG. 1 is a perspective view of a wire spinner 10 according to the present invention. The wire spinner 10 generally comprises a support section 12 having an upright section 14 and a base section 16. The upright section 14 is centrally located on the base section 16. The upright section 14 has a top end 18 and lower end 20. The top end 20 is preferably a solid, generally closed structure. The upright section 14 generally forms a conical or cylindrical body 24. An opening 26 is located on the top portion of the cylindrical body. The opening 26 can act as a handle for the wire spinner.

Still referring to FIG. 1, the base section 16 extends from the lower end 20 to a bottom end 28. The base section 16 preferably forms a circular body 30 having a sidewall 34 extending from the lower end 20 to the bottom end 28. The body 30 could form other shapes as well. The support section 12 forms a cavity 32 that includes the internal portion of the upright section 14 and the base section 16.

Figure 2:
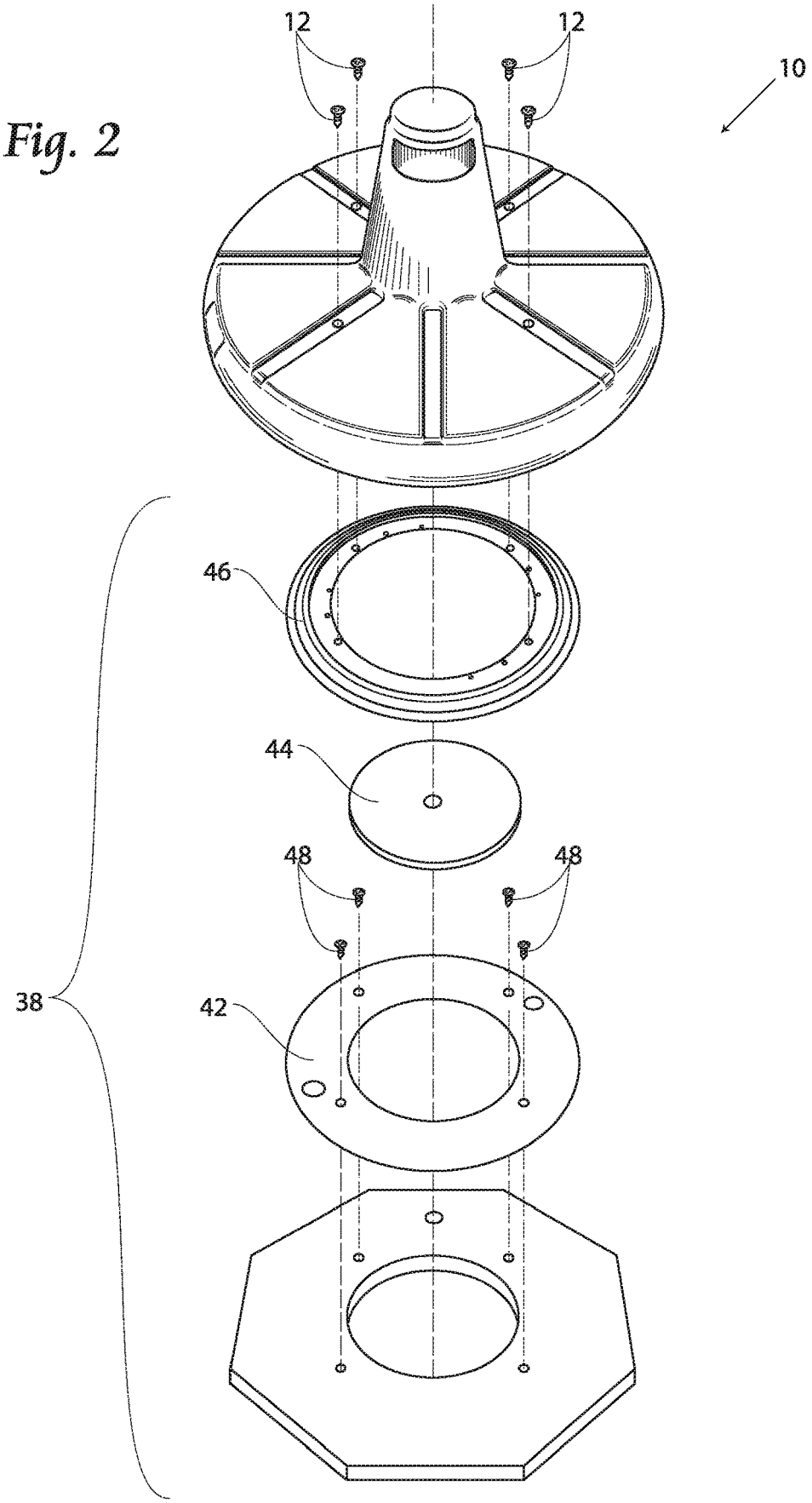
FIG. 2 is an exploded view of the wire spinner of FIG. 1.

FIG. 2 demonstrates an exploded view of the wire spinner 10 of FIG. 1. An assembly 38 is shown. The assembly 38 generally has a base plate 40 with a gasket 42 positioned over the base plate 40. A rotation plate 44 is situated over the gasket 42, with a rotation flange 46 situated over the rotation plate 44. The assembly will be secured within the cavity 32 of the wire spinner 10 with a plurality of fasteners 48. The Further, the assembly 38 will be secured in such a manner that the support section 12 will be able to spin or rotate with respect to the base plate 40. The fasteners 48 could be a variety of devices, such as screws, rivets, clips, or other similar fastening devices that will allow the various elements of the spinner 10 to be secured as discussed.

Preferably, the rotation flange 46 will be secured directly to the support section 12. The rotation flange 46 will be sandwiched between the rotation plate 44 and the base plate 40, with the rotation plate 44 and base plate directly connected to one another. The gasket 42 is preferably made of a flexible material, such as felt, silicone or rubber, that can compress and prevent dirt or debris from getting onto the rotation plate 44 or flange, thereby minimizing wear and tear on the spinning mechanics of the assembly 38.

FIG. 3 shows a bottom view of the wire spinner 10. The base plate 40 is shown within the circular body 30 of the wire spinner 10. As is shown, the base plate 40 has an octagonal shape. However, the base plate 40 could be of any shape so that it could freely rotate with respect to the circular body 30 and the support section 12. The base plate 40 also has an opening 50 that allows for access into the cavity 32. The base plate 40 may be made of any durable material, such as plywood, plastic, fiberglass, or similar stiff material.

Referring now to FIGS. 4 and 5, the wire spinner is shown supporting a spool of wire 5. The wire 5 is situated around the upright section 14 and rests upon the base section 16. As the wire 5 is pulled outwardly from the wire spinner 10, the wire 5 will be depleted, but will remain on the base section 16.

Figure 6:
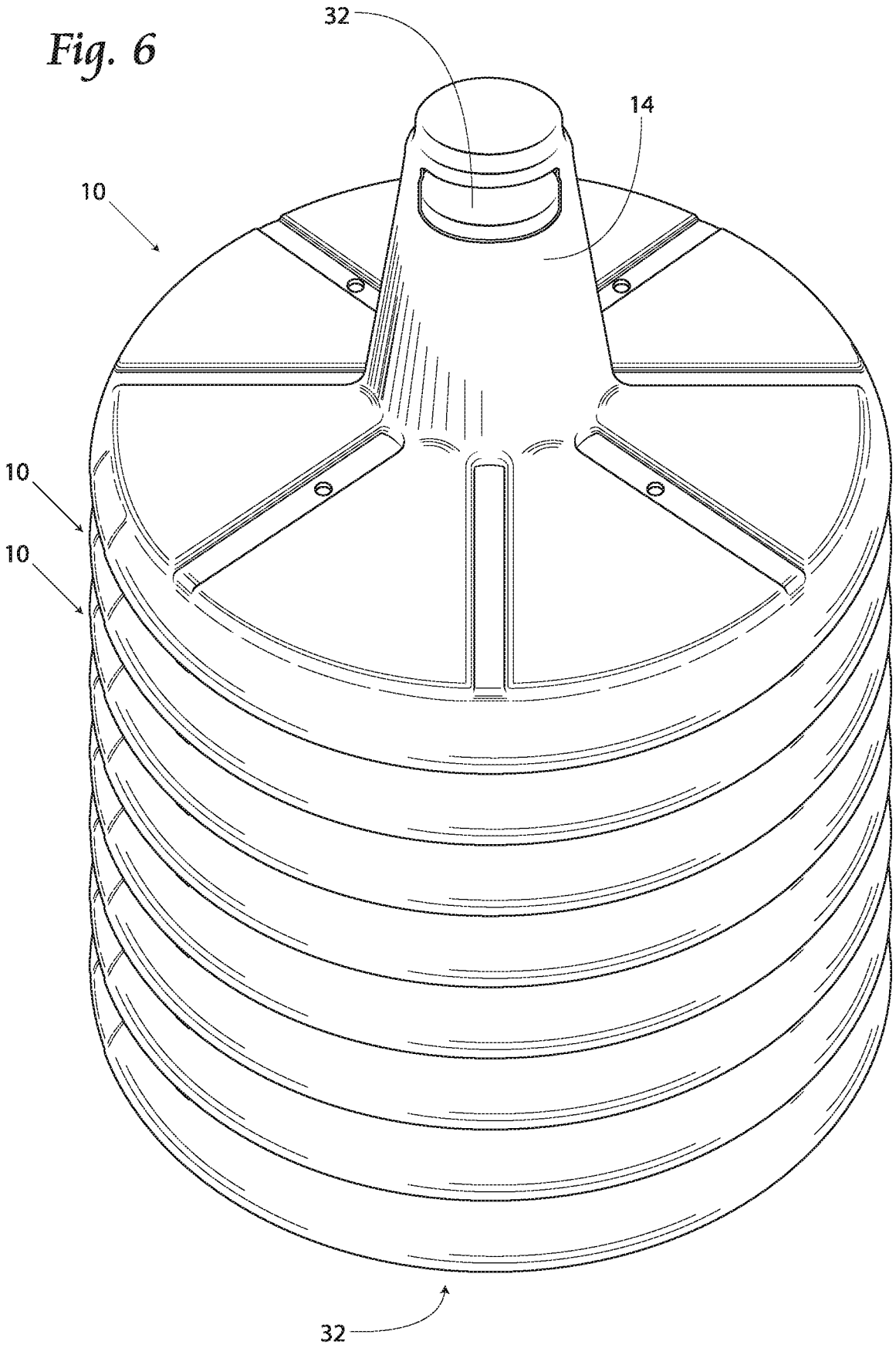
FIG. 6 is a perspective view of multiple wire spinners of the present invention staked upon one another.

The wire spinner 10 of the present invention also has advantages over prior art devices in that they are easily stored after use. As is shown in FIG. 6, multiple wire spinners 10 are stacked upon one another. The upright section 14 of a wire spinner 10 can fit into the cavity 32 of another wire spinner 10 and so forth.

The present invention simplifies the ability for the user to store and use wire, cable or other similar conduit material. It should be understood that the shapes and sizes of the present invention could be modified and still remain within the scope of the present invention.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A storage device for wire, said storage device comprising:

a support section comprising:

an upright section; and a base section centrally located around said base section;

a cavity formed within said support section;

a rotation assembly located within said cavity, said rotation assembly including a base plate, wherein said support section is rotatable with respect to said base plate; and wherein said rotation assembly further comprises a rotation flange in a rotational arrangement with said base plate, said rotation flange in a fixed arrangement with said support section.

2. The storage device according to claim 1 wherein said upright section is conical.

3. The storage device according to claim 2 further comprising an opening located in said upright section.

4. The storage device according to claim 3, wherein said opening forms a handle.

* * * * *